US011266210B2

(12) United States Patent
Tourrette et al.

(10) Patent No.: US 11,266,210 B2
(45) Date of Patent: Mar. 8, 2022

(54) ZIPPER DEVICE COMPRISING AN ELECTRICALLY CONDUCTIVE SLIDER

(71) Applicant: GENIUS OBJECTS, Bordeaux (FR)

(72) Inventors: Philippe Tourrette, La Rochelle (FR); Alexandre Faucher, Bordeaux (FR)

(73) Assignee: GENIUS OBJECTS, Bordeaux (FR)

( * ) Notice: Subject to any disclaimer, the term of this patent is extended or adjusted under 35 U.S.C. 154(b) by 436 days.

(21) Appl. No.: 16/330,627

(22) PCT Filed: Sep. 4, 2017

(86) PCT No.: PCT/FR2017/052336

§ 371 (c)(1),
(2) Date: Mar. 5, 2019

(87) PCT Pub. No.: WO2018/046828

PCT Pub. Date: Mar. 15, 2018

(65) Prior Publication Data

US 2021/0289892 A1 Sep. 23, 2021

(30) Foreign Application Priority Data

Sep. 7, 2016 (FR) ..... 16 58303

(51) Int. Cl.
*A44B 19/26* (2006.01)
*A44B 19/34* (2006.01)

(52) U.S. Cl.
CPC ..... *A44B 19/26* (2013.01); *A44B 19/346* (2013.01)

(58) Field of Classification Search
CPC ..... A44B 19/26; A44B 19/24; A44B 19/346; A41D 2300/322; H01H 9/34; H01H 1/12; H01H 1/365
See application file for complete search history.

(56) References Cited

U.S. PATENT DOCUMENTS 2,877,439 A * 3/1959 Avery ..... H01R 9/00 439/285
3,622,936 A * 11/1971 Negishi ..... H05K 3/365 439/285

(Continued)

FOREIGN PATENT DOCUMENTS

WO 2015/118191 8/2015

OTHER PUBLICATIONS

Chinese Office Action dated Feb. 8, 2021.

(Continued)

*Primary Examiner* — Robert Sandy
(74) *Attorney, Agent, or Firm* — Ipsilon USA, LLP

(57) ABSTRACT

The invention provides a monitor device for monitoring the state of a zip closure system comprising an electrically conductive slider (4), a first tape (1), and a second tape (2), each provided with a series of members (3), such as teeth or spiral turns, that can be coupled and uncoupled with the series of corresponding members (3) by moving said slider. Two strips (5, 6) of electrically conductive material, referred to as conductive strips, that are secured to the first tape (1) and that are arranged transversely, preferably perpendicularly, relative to the longitudinal axis of the first tape (1). Said strips (5, 6) and the slider (4) are configured in such a manner that the two strips (5, 6) are electrically connected together by the slider (4) when said slider (4) is moved level with said strips (5, 6). Said device further comprises a detector system (8) configured to detect the state of electrical continuity between the two strips (5, 6).

10 Claims, 3 Drawing Sheets

(56) References Cited

U.S. PATENT DOCUMENTS

| | | | | |
|---|---|---|---|---|
| 3,753,201 | A * | 8/1973 | Ohman | H01C 10/08<br>338/92 |
| 5,499,927 | A * | 3/1996 | Ohno | H01R 13/28<br>29/408 |
| 9,231,327 | B1 * | 1/2016 | Liu | H01R 13/28 |
| 2009/0195400 | A1 | 8/2009 | Oreshkin | |
| 2010/0136804 | A1 * | 6/2010 | Strickland | H01R 12/78<br>439/65 |
| 2020/0323283 | A1 * | 10/2020 | Cooper | A44B 99/00 |

OTHER PUBLICATIONS

International Search Report dated Jan. 12, 2017.
International Search Report dated May 4, 2017.
Office Action dated May 11, 2021.

* cited by examiner

ZIPPER DEVICE COMPRISING AN ELECTRICALLY CONDUCTIVE SLIDER

RELATED APPLICATION

This application is a National Phase of PCT/FR2017/052336, filed on Sep. 4, 2017, which claims the benefit of priority from French Patent Application Nos. 16 58303, filed on Sep. 7, 2016, the entirety of which are incorporated by reference.

FIELD OF THE INVENTION

The present invention relates to a monitor device for monitoring the state of a zip closure system for an article such as a bag, baggage, a pair of trousers, a pair of shorts, a skirt, or some other analogous garment, a text, a tarpaulin, a cover, leather goods such as a wallet, a purse, or a pouch. The present invention also relates to the corresponding article.

PRIOR ART

Certain transport articles, such as bags or baggage, include a closure system of the zip closure type. When a bag opens involuntarily, there is a risk of losing its content. In similar manner, there is a risk of the content of the bag being stolen if the bag is open, unknown to its proprietor.

Furthermore, trousers usually include a fly, which may likewise be formed by a closure system of the zip closure type. It can happen that the fly remains open or partially open, which constitutes a risk of embarrassing third parties if the wearer of the trousers does not notice quickly.

The state of the art, and in particular document EP 0 303 481, discloses devices enabling the state of a zip closure system to be monitored. In an embodiment of document EP 0 303 481, the monitor device comprises a detector-and-signaling device with two connectors, one connected to teeth of one row of a zip closure and the other connected to teeth of the other row of the closure. The teeth to which the connectors are connected face each other in such a manner that the connectors are at the same level, and that, when the zip closure level with the connectors is in the closed state, said connectors are brought into contact with each other, thereby closing an electrical circuit in which there flows a current coming from an electrical power supply. The flow of this current is detected by the detector-and-signaling device, which can deduce therefrom the open or closed state of the zip closure, and can signal that state.

Nevertheless, in the known solution of Document EP 0 303 481, and as stated above, the connectors are arranged at the same level along the zip closure, such that there exists a non-negligible risk of the connectors touching each other, even though the zip closure is not closed. The detector-and-signaling device then does not signal the open state of the zip closure since the detector-and-signaling device detects contact between the connectors.

Furthermore, electrically connecting connectors or electric wires to teeth of a zip closure is an operation that is difficult to perform in a manner that is reliable and long-lasting. Specifically, a zip closure is a system that is operated frequently and the connection between a connector and a tooth runs the risk of becoming degraded quickly.

Furthermore, connecting one of the connectors on one side of the zip closure to the other connector on the opposite side of the zip closure requires electrical connection wires to be passed all around the trousers, which is complicated and increases the risk of degrading the device.

An object of the invention is thus to propose a novel device for monitoring the state of a zip closure system for an article, and enabling the above-described problem to be resolved in full or in part.

SUMMARY OF THE INVENTION

To this end, the invention provides a monitor device for monitoring a zip closure system, said device comprising:

- a first tape and a second tape, each provided with a series of members such as teeth or spiral turns, that can be coupled and uncoupled with the series of corresponding members; and
- a slider made of electrically conductive material, referred to a conductive slider, the conductive slider being arranged with the series of members in such a manner as to enable the members of the two series to be coupled together by moving in one direction along said series of members and to enable them to be uncoupled by moving in the opposite direction;

the monitor device being characterized in that it comprises:

- at least two strips of electrically conductive material, referred to as conductive strips, that are secured to the first tape and that are arranged transversely, preferably perpendicularly, relative to the longitudinal axis of the first tape, said strips and the slider being configured in such a manner that the two strips are electrically connected together by the slider when said slider is moved to be level with said strips; and
- a detector-and-signaling system configured to detect the state of electrical continuity between the two strips.

The term "state" is used of the zip closure system to mean the configuration in which said zip closure system is to be found relative to its slider, so that said state of the system may be the closed or open state of zip closure system, or the position of the slider along the movement axis of said slider, or indeed the movement direction of the slider.

Such a design for the monitor device serves in particular to detect reliably the open or closed state of the zip closure without any risk of false contact since it is the slider that forms the switch providing contact between the strips, unlike the prior art solution in which it is possible for electrical contact between conductive teeth to arise in unwanted manner.

Furthermore, the fact of using conductive strips secured to the tapes increases the reliability of the device with a cost that is lower than that of the solution of Document EP 0 303 481, which requires connectors or electric wires to be electrically connected to teeth. Such a design for the monitor device of the invention stands up well over time to frequent stressing, and the risk of deterioration is limited.

Furthermore, by arranging the strips on the same tape, and thus on only one side of the zip closure, it is possible to have electric connection wires on one side of the zip closure only, and thus to obtain a monitor device that is compact, while reducing any risk of the device being degraded. The monitor device can thus be fitted easily to various articles that make use of a zip closure system.

Having the strips on the same side makes it possible to arrange the monitor device, and in particular the electrical and electronic elements and the corresponding connections, on one side only of the zip closure relative to the movement axis of the slider. It is thus possible to design an article, e.g. a tent, in which a portion of the article is connected to the first tape and another portion is connected to the second tape in such a manner that the portions are separable from each other when the closure system is in the open state. Specifically, by arranging the strips, and thus the device, on one side only, it is possible to localize the device on only one of said separable portions of the article, thereby making it possible to separate the portions without them remaining connected together by elements of the device such as connections, and without any need to undo the device or some of its connections. Such a design is particularly advantageous for a tarpaulin or a tent, for example, when a removable portion of the tarpaulin may be taken away to be sheltered, e.g. in a garage.

The state of electrical continuity between the two strips may be detected by detecting the closed or open state of the electric circuit formed between the two strips, which corresponds to detecting electrical continuity or absence of electrical continuity between the two strips. Advantageously, the second strip is connected to a non-zero electric potential of an electrical power supply, and this is detected by said system when the two strips are electrically connected together by the slider.

According to an advantageous characteristic of the invention, said strips are secured to the first tape by being:

- woven in the weave of the first tape; and/or
- sewn onto one or both faces of the first tape; and/or
- printed on one or both faces of the first tape; and/or
- adhesively bonded or deposited on a surface of the first tape; and/or
- crimped on one or both faces of the first tape.

According to an advantageous characteristic of the invention, said zip closure device further comprises a third conductive strip, and the detector-and-signaling system is configured also to detect a state of electrical continuity between the second conductive strip and the third conductive strip.

Such a design for the device using three strips makes it possible to detect the direction of movement of the slider. Specifically, the direction of movement of the slider, i.e. the direction for closing the members of the series of members or the direction for opening them, can be detected as a function of the open or closed states as detected in succession for the electric circuits formed between the strips, i.e. as a function of the electrical continuity states that are detected between the first and second strips and between the third and second strip.

According to an advantageous characteristic of the invention, the conductive strips are situated in the proximity of one end of the first tape.

According to an advantageous characteristic of the invention, the members that can be coupled and uncoupled of each series of members are made of electrically insulating material, such as nylon.

Naturally, the device of the invention may also operate with series of members made of electrically conductive material, such as teeth made of metal.

According to an advantageous characteristic of the invention, the detector-and-signaling device has a first input terminal, preferably forming a logic input, connected by a conductive filamentary element, such as an electric wire, to the first strip, and the second strip is connected by a conductive filamentary element, such as an electric wire, to an electric potential supplied for example by an electrical power supply.

According to an advantageous characteristic of the invention, the detector-and-signaling device has a second input terminal, preferably forming a logic input, connected by a conductive filamentary element, such as an electric wire, to the third strip.

The invention also provides an article, preferably an article of clothing, such as a pair of trousers openable in the middle in front or a jacket having an openable pocket, said article presenting an openable portion fitted with a zip closure system, said article being characterized in that it is provided with a monitor device as described above, said zip closure system of the article comprising said zip closure system of the monitor device.

In a particular aspect, said article is a garment including a closure button at the waist of the garment, said garment also including an electrical power supply, such as a button cell, received in said closure button and configured to power said detector-and-signaling system.

The invention also provides baggage, such as a backpack, presenting an openable portion fitted with a zip closure system, said baggage being characterized in that it is provided with a monitor device as described above, said closure system of the baggage comprising said zip closure system of the monitor device.

The invention also applies to an article formed by a tarpaulin, a pouch, a purse, a tent, or indeed any article of leather goods, and more broadly any object/article containing a zip closure system.

BRIEF DESCRIPTION OF THE DRAWINGS

Other characteristics and advantages of the invention appear further from the following description, which is purely illustrative and non-limiting, and which should be read with reference to the accompanying drawings, in which.

DETAILED DESCRIPTION

Figure 1:
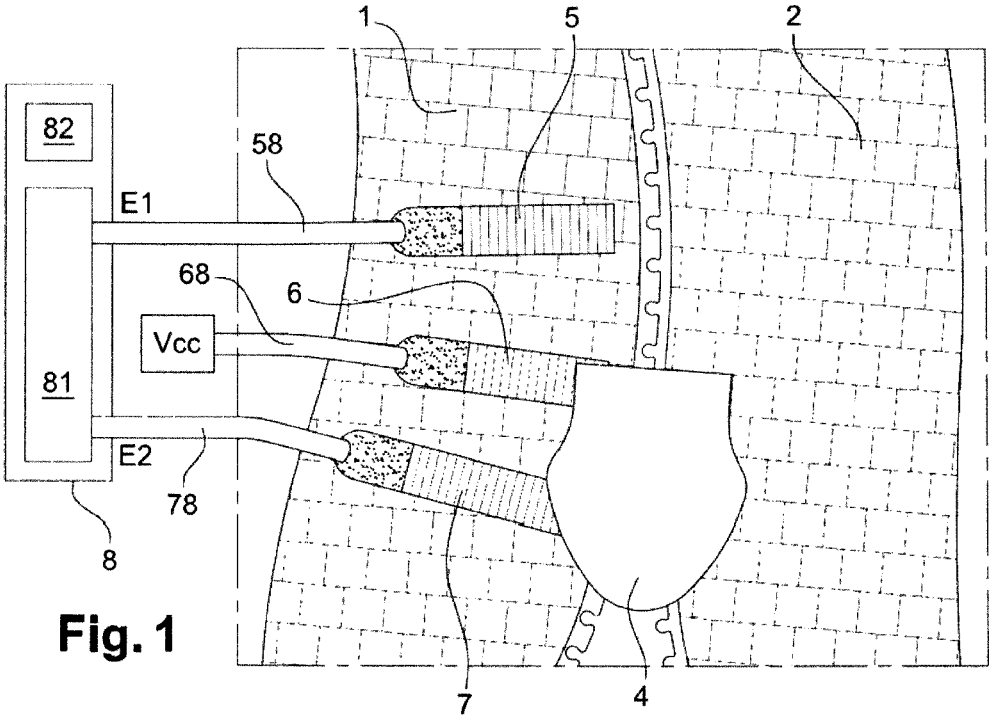
FIG. 1 is a rear view of a zip closure system having a detector-and-signaling system in accordance with an embodiment of the invention.
Figure 2:
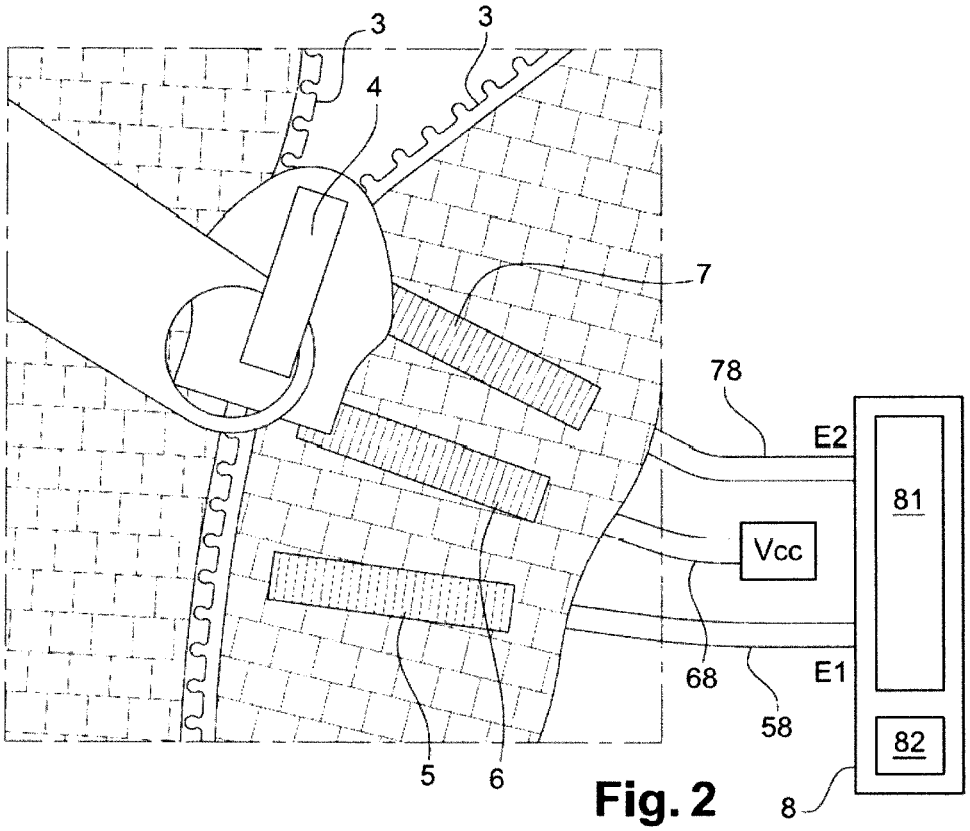
FIG. 2 is a front view of a zip closure system provided with a detector-and-signaling system in accordance with an embodiment of the invention.

The concept of the invention is described more completely below with reference to the accompanying drawings, which show embodiments of the concept of the invention. In the drawings, sizes and relative sizes of elements may be exaggerated for the purposes of clarity. In all of the drawings, similar numbers refer to elements that are similar. Nevertheless, this concept of the invention can be implemented in numerous different forms and it should not be interpreted as being limited to the embodiments described below. On the contrary, these embodiments are given so that the description is complete, and they communicate the extent of the concept of the invention to persons skilled in the art. Consequently, the extent of the invention is not defined by the accompanying drawings.

Any reference in the description to an "embodiment" means that a particular function, structure, or characteristic described with reference to an embodiment is included in at least one embodiment of the present invention. Thus, the term "in an embodiment" as used at various locations in the specification does not necessarily refer to the same embodiment. In addition, the particular functions, structures, or characteristics may be combined in any appropriate manner in one or more embodiments.

With reference to the figures and as summarized above, the invention relates to a monitor device for monitoring the state of a zip closure system. As summarized above, the "state" of the zip closure system is defined relative to its slider such that said state of the system may be the closed state or the open state of the system or it may be the position of the slider, or indeed it may be the travel direction of the slider.

In the example shown in the figures and as described in detail below, the system has two or three strips forming a group of strips that are situated at a given location along the travel axis of the slider. Provision may be made for the system to have a plurality of groups of strips spaced apart along said travel axis of the slider, each making it possible to detect the position and/or the travel direction of the slider by being connected to an electric potential and to inputs as explained below.

Said zip closure monitor device comprises a first tape 1 and a second tape 2. Each tape 1 presents a longitudinal edge provided with a respective series of members 3 that can be coupled and uncoupled with the series of corresponding members 3 arranged along said longitudinal edge of the other tape 2. In the description below, and as shown in the figures, said members are teeth, however in a variant it is possible to make provision for said members to be spiral turns.

The device also comprises a slider 4 made of electrically conductive material, referred to as a "conductive slider". The conductive slider 4 is arranged with the series of teeth 3 so as to enable the teeth 3 of the two series to be coupled together by moving in one direction along said series of teeth 3, and to enable them to be uncoupled by moving in the opposite direction.

The series of teeth, the strips on which they are fastened, and the slider arranged to couple them and to uncouple them depending on its direction of movement form the elements of a zip closure. Provision may be made for each tape to be constituted by a textile piece, e.g. a strip of woven fabric. In a variant, each tape may be made out of some other flexible material, e.g. out of plastics material, such as PVC, or even out of metal.

The zip closure monitor device also has at least two strips 5, 6 made of electrically conductive material and referred to as "conductive strips". In the example shown in the figures, the device has a third conductive strip 7. These conductive strips 7 are secured to the first tape 1 and they are arranged transversely, preferably perpendicularly, relative to the longitudinal axis of the first tape 1. The strips are all secured to the same tape 1, thereby facilitating the design of the device and enabling the device to be made more reliable and more compact.

Said strips 5, 6, and 7, and the slider 4 are configured in such a manner that the two adjacent strips 5 and 6 or the two adjacent strips 6 and 7 are electrically connected together by the slider 4 when said slider 4 is moved past said strips 5, 6 or past said strips 6, 7. For this purpose, the slider 4 is of a size that is suitable for making contact simultaneously with two adjacent strips when said slider is situated level with said strips. Conversely, when said slider is not situated level with the two strips 5, 6 or 6, 7, then said strips 5, 6 or 6, 7 are not electrically connected together.

Figure 6:
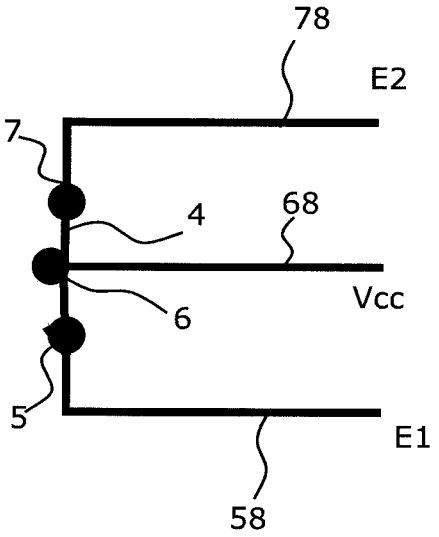
FIG. 6 is a fragmentary diagrammatic view of two electric circuits formed by a zip closure system provided with a detector-and-signaling system in accordance with an embodiment of the invention, with the first circuit in the closed state and the second circuit in the closed state.

In a variant, and as described in detail below, it is also possible to provide for the slider to contact all three strips 5, 6, and 7 simultaneously, as shown in FIG. 6, when the slider is long enough to touch all three strips simultaneously, thereby serving to further increase the reliability of the monitor device.

The device also has a detector-and-signaling system 8 configured to detect the closed or open state of the electric circuits formed between the two strips 5 and 6, and between the two strips 6 and 7. An embodiment of this detector-and-signaling system 8 is described below.

Said strips 5, 6, and 7 are secured to the first tape 1. Various ways of securing them can be envisaged. Said strips may be made by weaving an electrically conductive material in the weave of the first tape 1. The strips may also be sewn onto one or both faces of the first tape 1, and/or printed using an electrically conductive ink on one or both faces of the first tape 1. Said strips may also be adhesively bonded or deposited on the surface of the first tape 1, or indeed they may be crimped onto one or both faces of the first tape.

In a preferred embodiment, in order to be able to detect opening and closing of the zip closure effectively, the conductive strips 5, 6, and 7 are situated in the proximity of one end of the first tape 1. Advantageously, this end corresponds to the closed end of the zip closure, i.e. the end where the slider is located when the closure is in the closed state, i.e. the state in which the majority of the teeth are coupled together. With a garment, such as a pair of trousers or a skirt, said closure end is a top end, with the tape extending vertically while the garment is being worn.

Said detector-and-signaling system 8 has a signaling module 82, e.g. of the type that emits sound, and/or vibration, and/or light, and a detector module 81.

The detector module 81 is configured to detect the state of electrical continuity between the strips and to activate the signaling module 82 as a function of the detected continuity state(s).

Advantageously, said detector-and-signaling device 8 includes a processor unit, such as a microcontroller, having logic inputs E1 and E2 forming first and second input terminals for connection to the strips 5 and 7, as explained below. As described in detail below, the state of electrical continuity between two strips is detected by detecting the state of the logic input to which one of the two strips is connected, while the other strip is connected to a non-zero electric potential.

The signaling module 82 may comprise a module implemented in the microcontroller for issuing a warning signal, e.g. for sending to a receiver appliance, such as a Smartphone, and/or it may comprise a sound and/or visual emitter, that is connected to the output of the detector module and that is activated as a function of the result of the detection.

Provision may thus be made for the emitter module to be a radio communication module, e.g. using the Bluetooth standard.

The device has an electrical power supply, such as a button cell, configured to power said detector-and-signaling system.

Said device may include sealing means configured to ensure that said detector-and-signaling device 8 is waterproof.

In the example shown in the figures, the logic input E1 is connected by a conductive filamentary element 58, such as an electric wire, to the first strip 5, and the second strip 6 is connected to an electric potential, e.g. supplied by an electrical power supply Vcc. Likewise, the logic input E2 is connected by a conductive filamentary element 78, such as an electric wire, to the third strip 7. Advantageously, the electric potential of the strip 6 is supplied by a button cell that also powers the remainder of the electrically powered components of the device, such as powering the detector-and-signaling device 8.

Said detector module 81 is configured to detect a voltage greater than a threshold value being applied to the first input E1. Likewise, said detector module 81 is configured to detect a voltage greater than a threshold value being applied to the second input E2. Said voltage Vcc is greater than said threshold value. In particular, when the voltage applied to the input E1 or E2, specifically the voltage Vcc, is greater than said threshold value, the logic state of the input E1 is the active state of value 1. Conversely, the logic state of the input E1 or E2 is the inactive state of value 0.

The slider 4 forms a switch between the strips 6 and 7 and between the strips 5 and 6 so that, when the switch formed by the slider 4 is in the closed state between the strips 5 and 6, the detector module 81 detects that the input E1 is in the active state (value 1). The detector module 81 can thus determine that the slider is level with the two strips 5 and 6. Likewise, in the closed state of the switch formed by the slider 4 between the strips 6 and 7, the detector module 81 detects that the input E2 is in the active state. From the states of the logic inputs E1 and E2, the detector module 81 can thus deduce that the slider is level with the two strips 6 and 7.

In a variant, the second strip 6 could be duplicated to constitute one strip that is to form an electric circuit with the strip 5 and another strip that is to form an electric circuit with the strip 7 when the switch formed by the slider 4 is in the closed state, even though it is more efficient to use a single strip 6 in common both to the circuit including the logic input E1 and also to the circuit including the logic input E2.

In a variant, and as mentioned above, when the slider is long enough to touch all three strips simultaneously, it is also possible to provide for the slider to make contact simultaneously with all three strips 5, 6, and 7, as shown in FIG. 6, thereby making it possible to further increase the reliability of the monitor device. Under such circumstances, the detector module 81 may be configured to detect simultaneous active states at the inputs E1 and E2, and to include detecting this state for determining the position and/or the travel direction of the slider. When the slider is of a size suitable for touching only two of the strips at a time, detecting an active state on both of the inputs E1 and E2 can be used to detect an anomaly, e.g. as a result of undesired contact between the strips.

The electrical power supply of the device may be a button cell that is received in the hollow body of a button, such as a garment closure button, as described in the patent application filed under the No. FR 15/52283 and not yet published.

The above-described monitor device may be fitted to an article, such as a pair of trousers that can be opened in the middle in front or a jacket presenting a pocket that can be opened and having an openable portion fitted with a zip closure system. Under such circumstances, said zip closure system of the article may be formed by said zip closure system of the monitor device.

In a particular embodiment, said article is a pair of trousers with a fly and the zip closure system constitutes the fly of the trousers.

The monitor device as described above may also be fitted to a transport bag or pouch, or indeed baggage, such as a backpack, presenting an openable portion fitted with a closure system. Likewise, said baggage closure system may be formed by said zip closure system of the monitor device.

In another particular embodiment, said article is a tent or a tarpaulin presenting a portion that is openable and that is fitted with a closure system.

An example of the device of the invention in operation is described below with reference to FIGS. 3 to 5. When the power supply of the detector-and-signaling device is activated, e.g. by closing the closure button as described in the patent application filed under the No. FR 15/52283 and not yet published, the detector-and-signaling device is in a position to detect the state of electrical continuity between the strips 5 and 6 and between the strips 6 and 7.

The example described below applies to the context in which the zip closure system is fitted to a garment and the strips are used in the proximity of the top (closure) end of the zip system. Naturally, the monitor device is applicable to any type of article having a zip closure system as explained above.

The device of the invention makes it possible to determine the open or closed state of the closure system as a function of the state and/or the successive states detected by the detector-and-signaling system.

When the closure system is initially in the open position, with the slider 4 being in its bottom position, for example, and the user desires to close said zip closure, the user raises the slider 4 towards the strips. So long as the slider 4 has not yet come up to the strips 5 and 6, the electric circuits between the strips 5 and 6 and between the strips 6 and 7 are open, such that neither the input E1 nor the input E2 is connected to the potential Vcc of the strip 6. The module 81 can thus deduce that the zip closure is open and transmits that information to the signaling module so that, where appropriate, it issues or transmits a corresponding warning signal.

In order to avoid untimely signaling, in particular for a garment, and in order to leave the user time to don said garment, a time delay may be used so as to inhibit the signaling module for the duration of the time delay. Whatever the type of article, the time delay may be used to avoid triggering an unwanted signal, e.g. during a rapid back-and-forth movement of the slider in the vicinity of the position of the strips.

Figure 3:
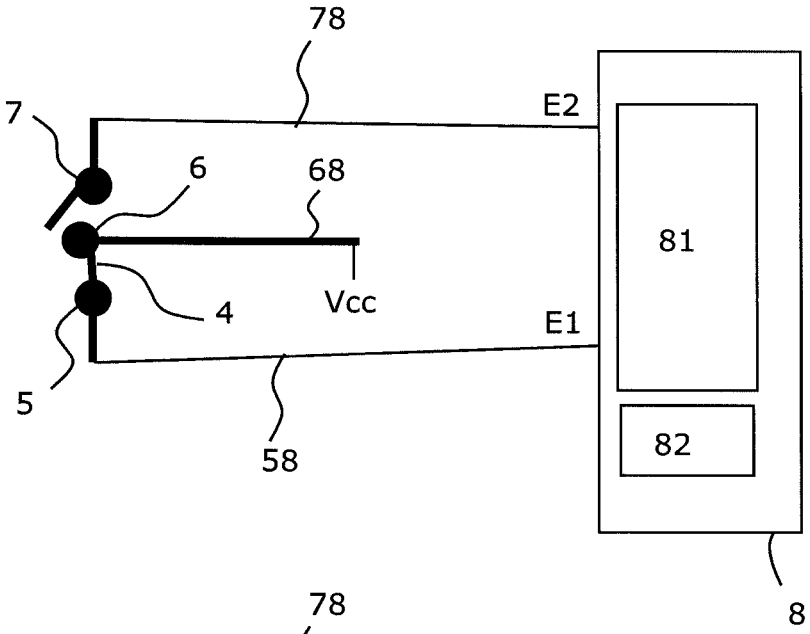
FIG. 3 is a diagrammatic view of two electric circuits formed by a zip closure system having a detector-and-signaling system in accordance with an embodiment of the invention, with the first circuit being in the closed state and the second circuit being in the open state.

As shown in FIG. 3, when the user raises the slider so that it comes level with the strips 5 and 6, the slider 4 touches both strips 5 and 6 simultaneously, thereby closing the electric circuit between the strips 5 and 6, so that the module 81 detects an "active" state, e.g. of value 1. As explained above, this active state is the result of electrical continuity between the strips bringing the voltage Vcc to the input E1. The module 81 thus detects that the slider is providing electrical continuity between the strips 5 and 6, and thus that it is situated across those two strips 5 and 6.

When the operator continues to raise the slider 4, it no longer connects the strips 5 and 6 together so the module 81 can detect an inactive state, e.g. of value 0, as a result of there being no voltage signal at the logic input E1. As shown in FIG. 5, when the slider 4 comes up to the strips 6 and 7, the slider forms a closed switch between the strips 6 and 7, and a result the module 81 can detect an active state corresponding to the voltage Vcc being brought to the input E2.

Figure 4:
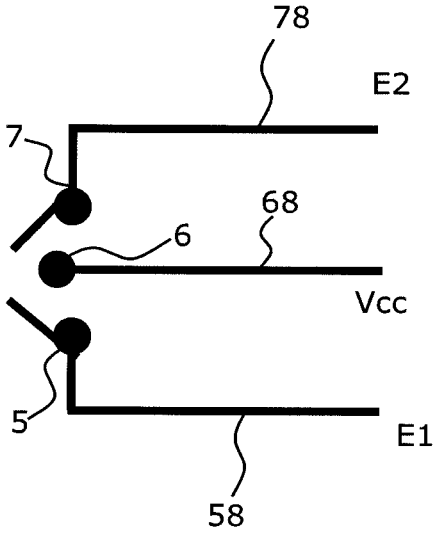
FIG. 4 is a fragmentary diagrammatic view of two electric circuits formed by a zip closure system provided with a detector-and-signaling system in accordance with an embodiment of the invention, with the first circuit and the second circuit both in the open state.
Figure 5:
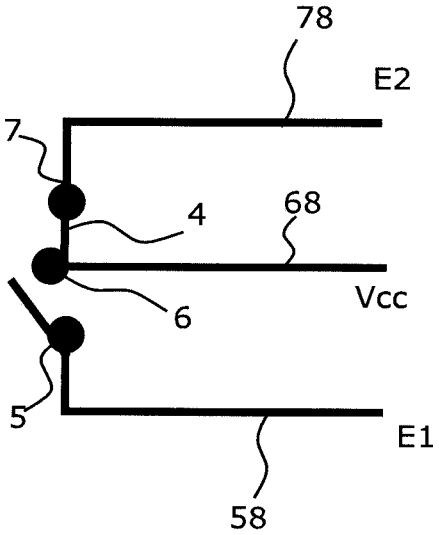
FIG. 5 is a fragmentary diagrammatic view of two electric circuits formed by a zip closure system provided with a detector-and-signaling system in accordance with an embodiment of the invention, with the first circuit in the open state and the second circuit in the closed state.

As shown in FIG. 4, when the slider is traveling away from the strips 5, 6, and 7, the slider 4 no longer closes electrical contact between the strip 6 and either of the strips 5 and 7, such that the module 81 can detect an inactive state on both the logic inputs E1 and E2.

The detector-and-signaling system 8 has a memory and it is configured to store the detected states. The detector-and-signaling system 8 is thus configured to detect that the slider has moved in an upward direction, i.e. the closure direction, when it detects in succession an active state on the input E1 (connected to the strip 5 that is further away from the closure end from among the two strips 5 and 7), followed by an active state on the input E2 (connected to the strip 7 that is closer to the closure end from among the two strips 5 and 7). Conversely, the module 8 is also configured to detect that the slider has been moved downwards or in the opening direction on detecting successively an active state on the input E2 followed by an active state on the input E1.

The active state may be a steady state or it may be transient state. The term "steady" means that the slider remains in place for a given duration across the two strips. Thus, on activating the power supply, it may happen that the slider is already positioned across two strips, e.g. being in contact with the strips 6 and 7 when the zip closure is in the closed state. The term "transient" is used to mean that the state detected on the input E1 or E2 passes from 0 (inactive) to 1 (active) in a short period of time, e.g. 1 second, or indeed that the state detected on the input E1 or E2 goes from 0 (inactive) to 1 (active) and then goes back to 0.

Advantageously, the system operates by detecting transient electrical states on the inputs E1 and E2, thus making it possible to reduce its electricity consumption. Specifically, when the sensor is not in contact with at least two strips, the electricity consumption of the device is very low.

When only two strips are used, it is possible to detect opening and closing of the zip closure system. It is then appropriate to begin with initialization by defining the closed or the open state of the zip closure system. The system 8 is then configured to store the state of the logic input to which one of those strips is connected, while the other strip is connected to the power supply Vcc. The module 81 is configured, each time it detects an active state on the logic input, to determine that the closure system has changed to the opposite state, e.g. the open state, relative to the previously detected state, e.g. the closed state.

Whatever the embodiment, the system 8 may be configured so that an activation signal is issued by the signaling module 82 as a function of the state(s) detected by the module 81. Thus, when the module 81 detects that the zip closure is open, e.g. as a result of successively detecting the active state on the input E2 and then on the input E1, the signaling module may issue an audible and/or visual and/or luminous warning signal or indeed it may send a warning signal to an appliance, such as the user's Smartphone, in order to inform it about the state of the zip closure system.

The above-described functions and steps can be implemented in the form of a computer program or by using hardware components (e.g. programmable gate arrays). In particular, the functions and the steps performed by the detector-and-signaling device may be provided by sets of instructions or computer modules implemented in a processor or a controller or they may be provided by dedicated electronic components or by components of the field programmable gate array (FPGA) or the application specific integrated circuit (ASIC) type. It is also possible to combine software portions and electronic portions.

The computer programs or software instructions may be contained in program storage devices, e.g. computer readable digital data storage media, or executable programs. The programs or instructions may also be executed from program storage peripherals.

The invention is not limited to the embodiments shown in the drawings. Consequently, it should be understood that when the characteristics mentioned in the accompanying claims are followed by reference signs, those signs are included solely for the purpose of improving the intelligibility of the claims, and they are not in any way limiting on the scope of the claims.

Furthermore, the term "comprising" does not exclude other elements or steps. In addition, characteristics or steps that are described with reference to one of the embodiments described may also be used in combination with other characteristics or steps from other embodiments described above.

The invention claimed is:

1. A monitor device for monitoring a zip closure system, said monitor device comprising:

a first tape and a second tape, each provided with a series of members, that can be coupled and uncoupled with the series of corresponding members; and a conductive slider made of electrically conductive material, the conductive slider being arranged with the series of members in such a manner as to enable the members of the two series to be coupled together by moving in one direction along said series of members and to enable them to be uncoupled by moving in the opposite direction;

wherein said monitor device further comprises:

at least first and second conductive strips of electrically conductive material, that are secured to the first tape and that are arranged transversely relative to the longitudinal axis of the first tape, said first and second conductive strips and the conductive slider being configured in such a manner that the first and second conductive strips are electrically connected together by the conductive slider when said conductive slider is moved to be level with said first and second conductive strips; and a detector-and-signaling system configured to detect the state of electrical continuity between the first and second conductive strips.

2. The monitor device according to claim 1, wherein said first and second conductive strips are secured to the first tape by being:

woven in the weave of the first tape; or sewn onto one or both faces of the first tape; or printed on one or both faces of the first tape; or adhesively bonded or deposited on a surface of the first tape; or crimped on one or both faces of the first tape.

3. The monitor device according to claim 1, wherein said zip closure device further comprises a third conductive strip, and in that the detector-and-signaling system is configured also to detect a state of electrical continuity between the second conductive strip and the third conductive strip, in such a manner as to be able to detect the movement direction of the conductive slider.

4. The monitor device according to claim 3, wherein the detector-and-signaling system has a second input terminal connected by a conductive filamentary element to the third conductive strip.

5. The monitor device according to claim 1, wherein the members that can be coupled and uncoupled of each series of members are made of electrically insulating material.

6. The monitor device according to claim 1, wherein the detector-and-signaling system has a first input terminal connected by a conductive filamentary element to the first conductive strip, and the second conductive strip is connected by a conductive filamentary element to an electric potential supplied by an electrical power supply.

7. A baggage having an openable portion fitted with a zip closure system, wherein said baggage is provided with a monitor device according to claim 1.

8. An article comprising an openable portion fitted with a zip closure system, wherein said article is provided with a monitor device according to claim 1.

9. The article according to claim 8, wherein said article is a garment including a closure button at the waist of the garment, said garment also including an electrical power supply received in said closure button and configured to power said detector-and-signaling system.

10. The monitor device according to claim 1, wherein the conductive strips are situated in the proximity of one end of the first tape.

* * * * *